US007392861B2

(12) United States Patent
Fouillou et al.

(10) Patent No.: US 7,392,861 B2
(45) Date of Patent: Jul. 1, 2008

(54) STABILIZER FOR A ROD, PARTICULARLY A STRING OF DRILLING RODS

(75) Inventors: Didier Fouillou, Saint Martin en Biére (FR); Guy Lordat, Colombes (FR); Thierry Leroy, Singapore (SG); Jerome Prost, Meudon (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 112 days.

(21) Appl. No.: 10/522,822

(22) PCT Filed: Jul. 7, 2003

(86) PCT No.: PCT/EP03/07391

§ 371 (c)(1),
(2), (4) Date: Aug. 15, 2005

(87) PCT Pub. No.: WO2004/013451

PCT Pub. Date: Feb. 12, 2004

(65) Prior Publication Data

US 2006/0070731 A1 Apr. 6, 2006

(30) Foreign Application Priority Data

Jul. 31, 2002 (FR) ..... 02 09753

(51) Int. Cl.
*E21B 17/10* (2006.01)

(52) U.S. Cl. ..... 175/325.1; 175/325.5

(58) Field of Classification Search ..... 175/325.1, 175/325.5

See application file for complete search history.

(56) References Cited

U.S. PATENT DOCUMENTS

| | | | | |
|---|---|---|---|---|
| 2,572,307 | A | 10/1951 | Waltermire | |
| 3,754,609 | A | 8/1973 | Garrett | |
| 2003/0106719 | A1 * | 6/2003 | Herrera | 175/325.2 |

* cited by examiner

*Primary Examiner*—William P Neuder
(74) *Attorney, Agent, or Firm*—James L. Kurka; Jaime Castano

(57) ABSTRACT

Stabilizer (1) designed to be slid onto a rod (2), particularly a string of drilling rods. It comprises at least one elastic part (4) that can deform when the stabilizer (1) is held in an initial position in compression against a shoulder (5) of the rod (2), this elastic part (4) compensating for play that may appear later between the stabilizer (1) and the rod (2).

Application particularly to drilling for oil wells.

33 Claims, 6 Drawing Sheets

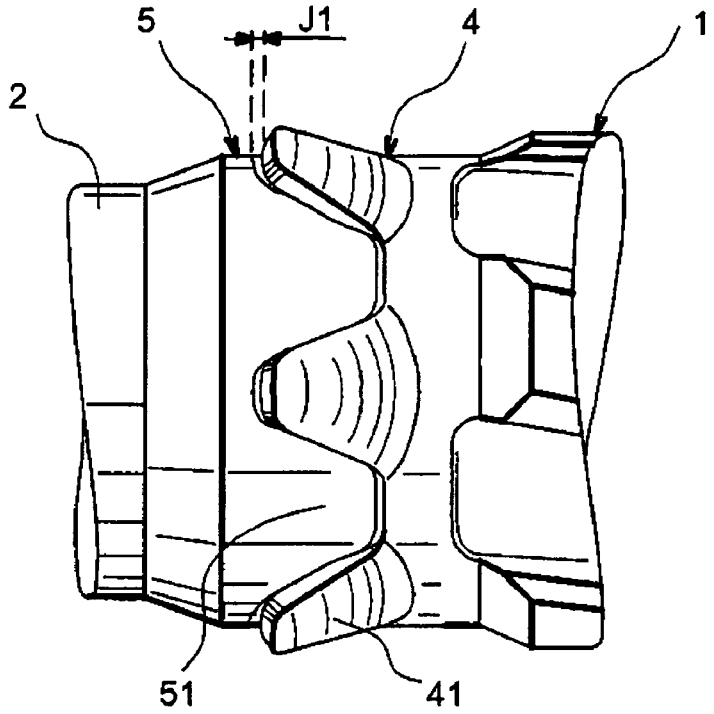
FIG. 2
FIG. 3A
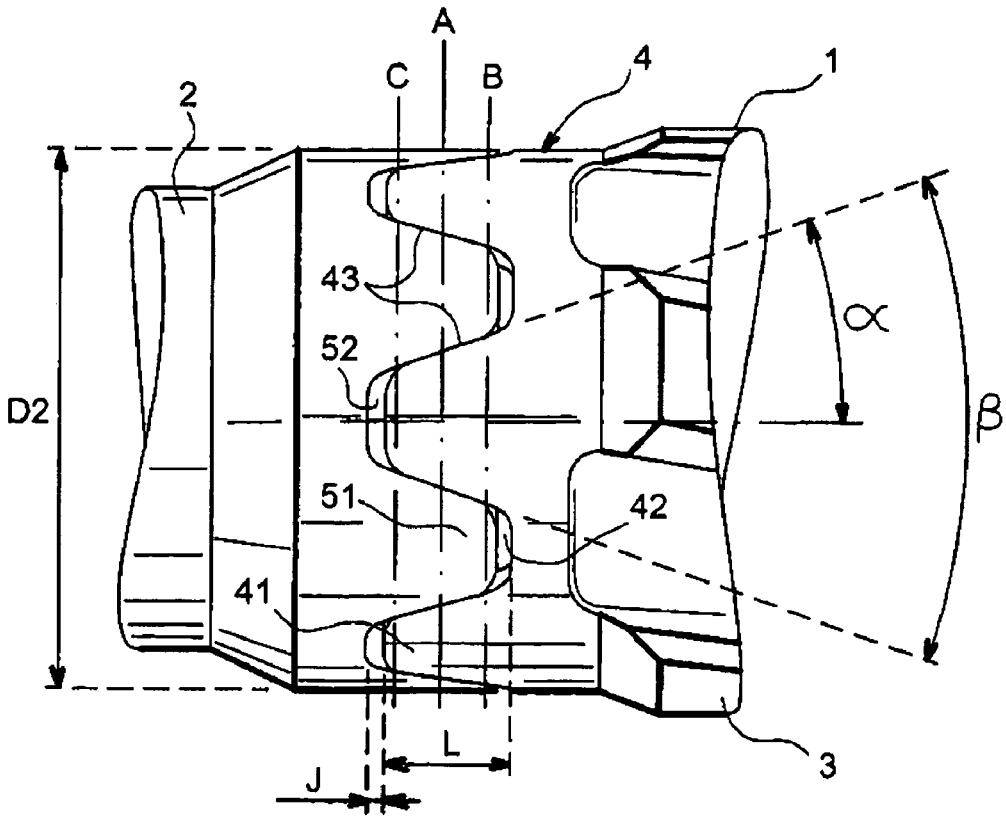

STABILIZER FOR A ROD, PARTICULARLY A STRING OF DRILLING RODS

TECHNICAL FIELD

The present invention relates to a stabilizer for a rod, and particularly a string of drilling rods. Its preferred application is the oil industry. Stabilizers are devices that can be placed around rods in a string of drilling or production rods. They are usually used to control the orientation of the drilling by guiding the string of rods and/or the drilling tool at the end of it and to position a string of rods in the bored hole, for example during production.

STATE OF THE PRIOR ART

A string of drilling rods usually comprises a sequence of recessed rods and terminates with a drilling tool, for example such as a drilling bit. Rods closest to the drilling bit are called drill stems; these rods are usually heavier than the others and they apply sufficient weight on the drilling bit so that it breaks into the geological formation, simply called the "formation" in the following.

Several stabilizers are usually used at different spacings along the drilling rods. These stabilizers are preferably located on the drill stems. They bear on the borehole wall and are used as guides to position the string of rods in the formation. The stabilizers are usually in the shape of a sleeve with a maximum outside diameter equal to approximately the diameter of the borehole. This sleeve comprises elements that project towards the formation to maintain contact with the formation.

High forces are applied to stabilizers during drilling or while lowering or removing the rod string. Stabilizers must be sufficiently robust to resist these forces without moving or deforming with respect to the rod.

French patent application FR-A1-2 493 908 describes a stabilizer in the form of a split sleeve that slides onto a rod in a string of rods. Screw-nut assemblies bring the two edges of the slit together to clamp the sleeve around the rod. The sleeve bears on helical blades on the outside that come into contact with the borehole wall and enable circulation of drilling mud.

Measurements or loggings are frequently made during the drilling operation. In this case, the string of rods is instrumented, in other words one or several rods close to the drilling tool are provided with a measurement device on the inside, for example including a sensor, a nuclear source, one or several electrodes, etc.

The instrumented rod may be an LWD (Logging While Drilling) tool. The LWD tool measures the physical properties of the formation during drilling. In one variant, the instrumented rod may be an MWD (Measurement While Drilling) tool which measures the characteristics of the borehole itself. The same instrumented rod may make the two types of measurements.

The rod may then be stressed. It may be elongated, or it may be compressed radially due to a pressure differential. The instrumented rods are provided with an annular space containing the measurement device to which the pressure differences are applied. The effect of the above mentioned stress is to reduce the cross section of the rod. Due to this reduction in cross section and the resulting elongation of the rod, the stabilizer will no longer be tight on the rod. It will be able to move freely in translation and in rotation. Similarly, the stabilizer and the rod can expand differently under the effect of temperature differences, which can introduce a transverse and longitudinal play between the stabilizer and the rod.

In the case of nuclear measurements with γ rays, at least one source and at least one detector are placed in the rod. The wall of the rod is provided with a window transparent to γ rays in front of the detector and in front of the source. The stabilizer includes transparent areas that must be located in front of the windows of the rod. The stabilizer sleeve must be correctly oriented and must be correctly positioned longitudinally with respect to the measurement device contained in the rod, and it is not desirable for it to move during drilling.

The stabilizer described in French patent application FR-A1-2 493 908 is not well designed to satisfy these needs. This stabilizer is only tightened on the rod. In an unfavorable environment, it can easily lose its initial position, there is nothing to fix it longitudinally and/or in orientation.

To prevent displacement of the stabilizer with respect to the rod in translation or in rotation, it has been proposed to make stabilizers forming an integral part of the rod. The starting point is a tubular metallic part with a thick wall, projecting blades are machined at some locations and the rod diameter is reduced at other locations. Rods equipped in this way are prohibitively expensive, particularly in use. Furthermore, since not all boreholes have the same diameter, a rod fitted with such a stabilizer can only be used in a borehole with a determined diameter. Furthermore, since wear at the stabilizer cannot be repaired, the entire rod has to be replaced.

DESCRIPTION OF THE INVENTION

The present invention is designed to correct the disadvantages mentioned above. It describes a stabilizer that can be slid onto a rod, particularly in a string of drilling rods, the stabilizer remaining in a predetermined position with respect to the rod regardless of the conditions of use.

This invention achieves this by using a stabilizer designed to be slid onto a rod, that can deform when the stabilizer is held in an initial position in compression against a shoulder on the rod. This elastic part compensates for a play that may appear later between the stabilizer and the rod. The play may be a longitudinal play.

Co-operation of the elastic part with the shoulder blocks the stabilizer in rotation with respect to the rod in the initial position, this blockage in rotation being kept later. The elastic part is located at one end of the stabilizer and is designed to come into contact with the shoulder of the rod. The stabilizer also comprises a stiffer part than the elastic part, which is practically non deformable.

According to one embodiment, the stabilizer is in the form of a sleeve, the elastic part being a deformable tubular portion of the sleeve, this tubular portion being reversibly deformable. The deformable tubular portion may comprise a sequence of projecting parts along the longitudinal direction around its periphery, and separated by recessed parts. These projecting parts are designed to co-operate with the projecting parts of the shoulder, the projecting parts of the deformable tubular portion having sides that enable sliding and separating contact with the sides of the projecting parts of the shoulder during initial positioning.

According to one embodiment, this sliding and non-jamming contact is achieved by making the sides of the projecting parts of the deformable tubular portion approximately in the shape of a spiral. In a transverse section, the two sides of a projecting part of the deformable tubular portion delimit an angle at the vertex equal to or greater than an angle at the vertex delimited by two radii of the tubular portion approximately at the mid-thickness of the two sides. The projecting parts of the deformable tubular portion are flared out from their end and have longitudinal symmetry so that no rotation occurs during initial positioning of the stabilizer.

The present invention also relates to a rod designed to contain at least one stabilizer characterized as described above, comprising a shoulder that will co-operate with the stabilizer. The geometry of the shoulder matches the geometry of the elastic part of the stabilizer. The rod is designed to be fitted with external means that help to hold the stabilizer in compression, and it comprises means helping to hold the stabilizer in compression in contact with the shoulder, these means being intended to co-operate with external means.

The means that contribute to keeping the stabilizer in compression in contact with the shoulder may include at least one area on which a male thread is formed. In one variant, the means contributing to holding the stabilizer in compression with the shoulder may comprise at least one housing designed to hold a part in which one of the faces is provided with a male thread.

The shoulder of the rod is sufficiently rigid so that it is practically non deformable.

This rod may be a rod in a string of drilling rods. This rod may also be a drill stem. It may be instrumented like a logging while drilling tool (LWD) and/or like a measurement while drilling tool (MWD).

The present invention also relates to an assembly formed of at least one rod characterized as above, fitted with at least one stabilizer thus characterized. It also comprises external means that help to keep the stabilizer in compression, in contact with the rod shoulder.

The external means may be in the form of a ring threaded on the inside, to be screwed on the rod.

A first space is formed between the ends of the projecting parts of the deformable tubular part and the shoulder when the stabilizer is in position against the shoulder without compression. A second space smaller than the first space is formed between the ends of the projecting parts of the deformable tubular part and the shoulder when compression is applied to the stabilizer in the initial position.

BRIEF DESCRIPTION OF THE FIGURES

This invention will be better understood upon reading a description of example embodiments given for guidance and that are in no way limitative, with reference to the attached drawings wherein:

FIG. 2 shows a partial view of the stabilizer according to the invention in compression in contact with the shoulder on the rod;

FIGS. 3A, 3B, 3C, 3D, 3E and 3F show a top view of a stabilizer according to the invention, threaded on the rod and in contact with the shoulder, and transverse sections at different levels of its projecting elements, respectively;

Identical elements are referenced by the same reference characters. The drawings are not necessarily to scale.

DETAILED DESCRIPTION OF PARTICULAR EMBODIMENTS

Figure 1A:
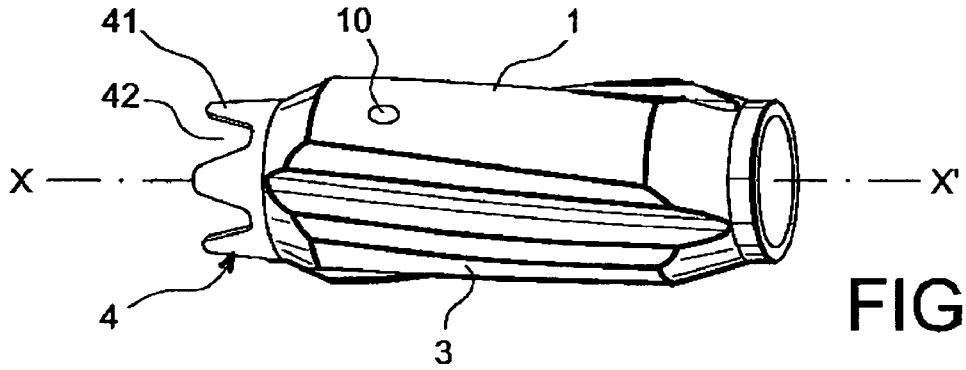
FIGS. 1A, 1B and 1C show a stabilizer according to the invention, a rod in a string of drilling rods adapted to hold the stabilizer according to the invention, and the stabilizer installed on the rod, respectively.
Figure 1B:
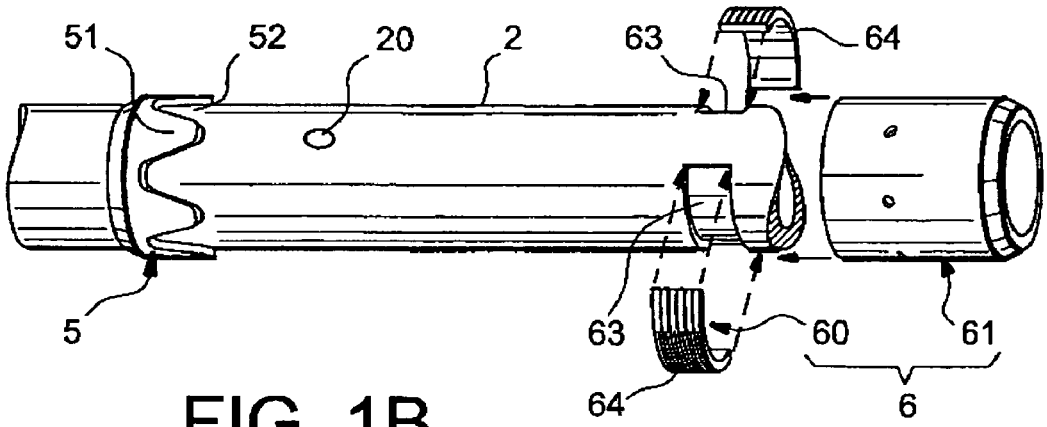
Figure 1C:
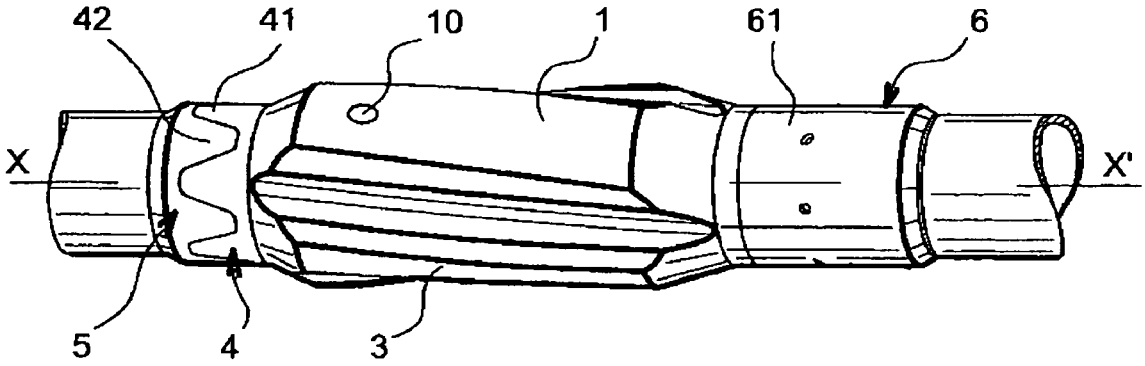

Refer to FIGS. 1A, 1B and 1C. FIG. 1A shows a stabilizer 1 according to the invention, FIG. 1B shows a rod 2, and particularly a string of drilling rods according to this invention around which the stabilizer 1 is placed, and FIG. 1C shows the stabilizer in place on the rod. This rod 2 built around an axis (not shown) is preferably a drill stem.

The stabilizer includes a body that bears on the borehole wall and acts as a guide to position the string of rods in the formation. The stabilizer 1 may be in the form of a sleeve built around a main axis XX'. However other configurations are possible in which the stabilizer is not cylindrical.

The stabilizer is designed to be added on by sliding around the rod 2. In the example described, the main axis XX' of the sleeve is then collinear with the axis of the rod 2. It would be possible for the stabilizer and the rod to be along different center lines. The stabilizer would then be offset from the rod.

The stabilizer is provided with elements 3 that project radially towards the outside of the body that will bear on the inside surface of a borehole. These elements 3 have been shown as helical blades, but other configurations are possible.

The stabilizer comprises at least one elastic part 4 that forms an integral part of the body. The elastic part 4 is deformed when the stabilizer is held in an initial position in compression in contact with the shoulder 5 of the rod 2. This deformation is reversible. It is intended to compensate for a play that could appear later between the stabilizer 1 and the rod 2. The elastic part is in the form of a deformable tubular portion 4, and this deformable tubular portion 4 can deform reversibly. Since this deformable tubular portion 4 is setback from the elements 3, it does not come into direct contact with the inside surface of the borehole, and therefore there is no risk of it being worn. Similarly, the shoulder 5 of the rod 2 does not come into direct contact with the inside surface of the borehole.

Compression means 6 (FIG. 1B) co-operate with the stabilizer 1 to hold it in place, once it has been inserted on the rod 2, in compression in contact with shoulder 5 of the rod 2. For example, these compression means 6 may be of the screw-nut type. The rod 2 comprises a part of these compression means, for example the screw part. Another part 61 of the compression means is external to the rod 2. This other part may be in the form of a ring with threads on the inside 61.

In order to put the stabilizer 1 into place, it is slid onto rod 2 so that at one end it comes into contact with the shoulder 5, the ring 61 which threads on the inside is also slid on, and it is screwed in the direction of the other end of the stabilizer 1. A predetermined torque is applied to the compression means 6, this torque corresponds to a force F that causes deformation of the elastic part 4. It is preferable if the compression means are then blocked so that they cannot come loose, the threaded ring 61 possibly being locked by an appropriate device.

This reversible deformation of the elastic part 4 is such that it will absorb a relative mechanical change between the rod and the stabilizer, that could occur later. It prevents the appearance of play between the stabilizer 1 and the rod 2.

For example, if the rod extends more than the stabilizer due to the pressure differential, the initial deformation of the elastic part 4 is reduced but the stabilizer continues to be held in compression against the shoulder of the rod. The stabilizer 1 does not become free on the rod 2, it cannot move in translation due to the permanent contact between the stabilizer 1 and the shoulder 5. At least there will be no longitudinal play.

We have seen that the rod 2 comprised means of holding the stabilizer 1 in compression against shoulder 5. In FIG. 1, these means 63 make use of at least one housing that will accommodate a cylindrical sector shaped part 64 on which a male thread is formed on one of its faces. When the part 64 is in the housing 63, the ring 61 threaded on the inside can be added on around the rod 2 by screwing it in, holding the stabilizer 1 in compression against the shoulder 5 of the rod 2.

FIG. 1B shows two diametrically opposite parts 64 each to be placed in a housing 63 of the rod 2. The fact that the male screw thread is removable means that it can easily be changed if it is damaged.

Figure 4:
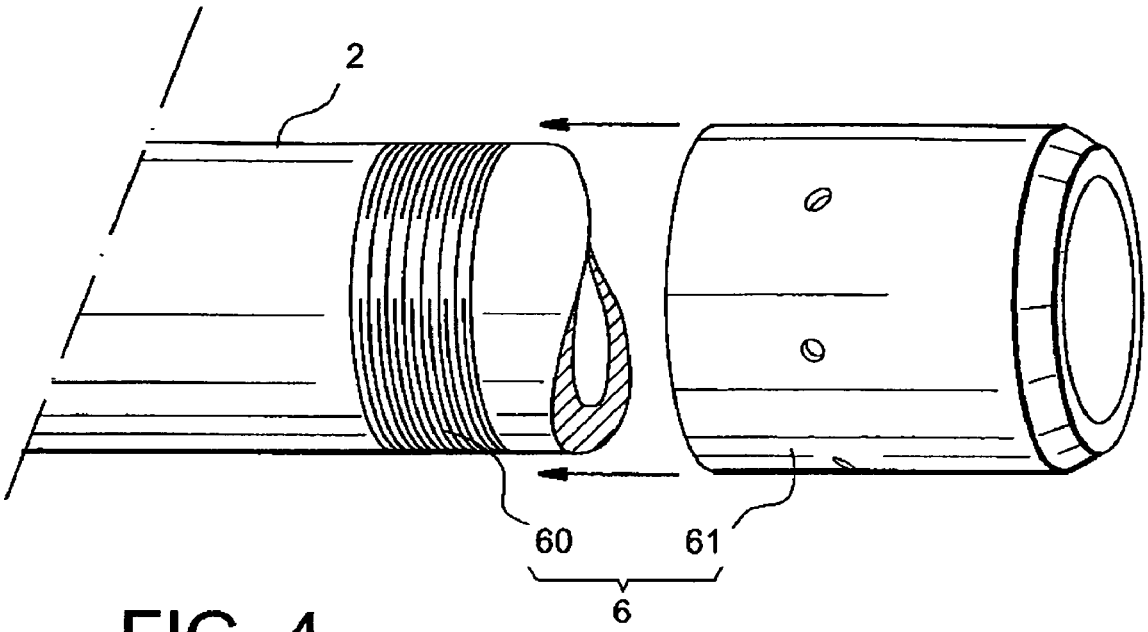
FIG. 4 shows a variant of means of holding the stabilizer according to the invention in compression when it is threaded on the rod.

The means on rod 2 that contribute to holding the stabilizer 1 in compression may consist of an area 60 of the rod 2 provided with a male thread as shown in FIG. 4. The area 60 provided with a male thread occupies the entire perimeter of the rod 2, but it would be possible for it to be otherwise.

When the rods string is in the borehole, particularly due to pressure and/or temperature and/or shock variations, even if longitudinal play is formed between the rod 2 and the stabilizer 1, this play will be absorbed by the elastic part 4, and the stabilizer 1 remains bearing in contact with the shoulder 5 of the rod 2. The remainder of the stabilizer is rigid, it will not deform or will deform by only a very small amount either during its placement or later. Similarly, the shoulder 5 is rigid, it cannot deform or will deform by only a very small amount when the stabilizer 1 is put into place in compression or later.

The elastic part 4 co-operates with the shoulder 5, and also fixes the angular position of the stabilizer 1 with respect to the rod 2. This blockage means that the stabilizer 1 and the rod 2 will retain the same relative angular position during operation. This structure is useful if the borehole is a rotary drill. Furthermore, for instrumented rods 2, this embodiment prevents the appearance of any angular offset between the rod and the stabilizer, at the risk of making the measurements impossible or distorted.

FIG. 1B shows a window 20 represented on rod 2, and FIGS. 1A and 1C show a transparent area 10 on the stabilizer at a projecting element 3. This transparent area 10 will approximately face the window 20 when the stabilizer is put into place on the rod 2. An attempt is made to hold it in place during drilling such that measurements or loggings can be made efficiently. The transparent zone 10 can be over designed so that it remains facing the window 20 regardless of the conditions.

In the embodiment shown in FIG. 1, the elastic part 4 is in the form of a deformable tubular portion 4 that is located at one end of the stabilizer 1. This portion bears on the shoulder 5 of the rod 2. The tubular portion 4 is formed along its periphery of a sequence of projecting parts oriented longitudinally 41 separated by recessed parts 42. These projecting parts 41 may be in the shape of crenels or any other derived form, for example such as teeth that are more pointed than the crenels or undulations that are less pointed than the crenels. The shape of these projecting parts 41 is adapted to create the reversible deformation.

The projecting parts of the deformable tubular portion are flared at their end. Furthermore, it is preferable that they should be symmetric about the XX' axis to prevent rotation if the deformable tubular portion 4 is translated with respect to rod 2, particularly during application of the force F applied in the initial phase during compression.

The shoulder 5 of the rod 2 has a matching geometric shape corresponding to the shape of the deformable tubular portion 4 with a sequence of projecting parts 51 separated by recessed parts 52 (FIG. 1B). The projecting parts 51 of the shoulder are not deformable or only very slightly deformable.

Figure 3B:
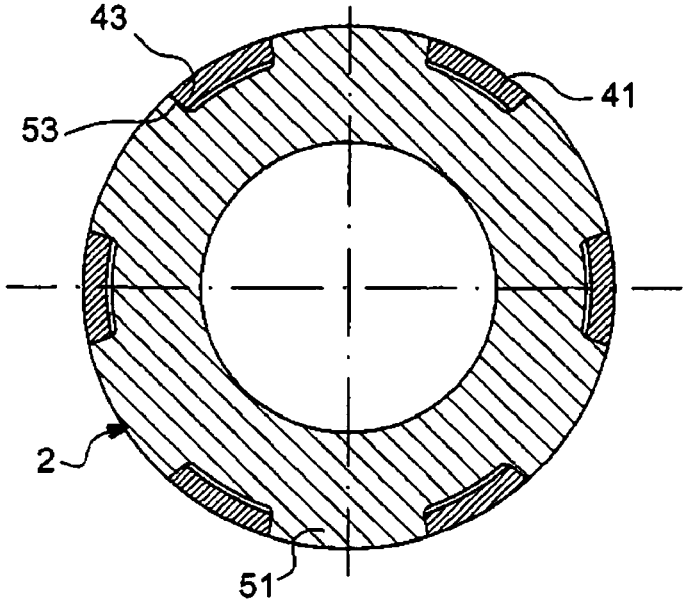

FIGS. 1A and 1C show indented projecting parts 41 of the stabilizer 1. When the stabilizer 1 is slid onto rod 2, it is pushed into contact with shoulder 5, the projecting parts 41 of the deformable tubular part engage between the matching projecting parts 51 of the shoulder 5 (FIG. 3B). The sides 43 of the indentations 41 of the deformable tubular portion 4 come into contact with the sides 53 of the projecting parts 51 of the shoulder 5. At this stage, a first space J separates the ends of the parts 41 projecting from the deformable portion 4, from the shoulder 5 and more particularly from the bottom of the recessed parts 52. This first space J can be seen in FIG. 3A. Approximately the same space is formed between the end of the projecting parts 51 of the shoulder 5 and the deformable tubular portion 4, and more particularly the bottom of the recessed parts 42.

When the deformable tubular portion 4 is deformed using the compression means 6 to bring it into the initial position, there is a second space J1 between the ends of the projecting parts 41 of the deformable portion 4 and the shoulder 5 (FIG. 2). The second space J1 is less than the first space J, but it is preferable that they should have the same sign, in other words that there is no overlap between the projecting parts 51 of the shoulder 5. The second space J1 between the end of the projecting parts 51 of the shoulder 5 and the deformable tubular portion 4 is approximately the same.

In FIG. 2, the stabilizer 1 is shown installed on the rod 2, the deformable tubular portion 4 is deformed and it can be seen that its projecting parts are open around the periphery, and are slightly raised above the projecting parts 51 of the shoulder 5. But the second space J1 does exist.

When the rod 2 elongates more than the stabilizer under the effect of temperature and/or the pressure in the formation, the projecting parts 51 will tighten together, but there will always be a space between the ends of the projecting parts of the deformable portion and the shoulder. The sides 43 of the indentations 41 of the deformable tubular portion 4 remain in contact with the sides 53 of the projecting parts 51 of the shoulder 5.

Surfaces coming into simultaneous contact with the shoulder 5 and the deformable tubular portion 4 slide with respect to each other along a separating trajectory, so that the deformable tubular portion 4 can deform when the compression means 6 are activated. This is done by forming an approximately spiral shaped profile on the projecting parts 41, 51 of the deformable tubular portion 4 and the shoulder 5.

Figure 3C:
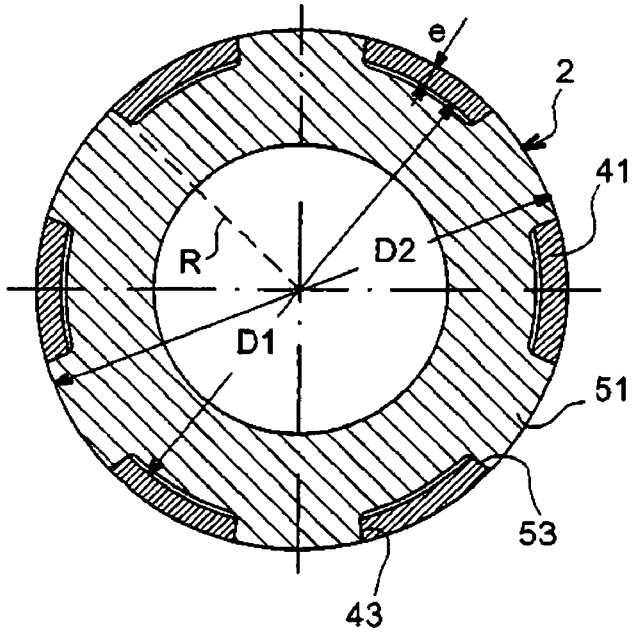
Figure 3D:
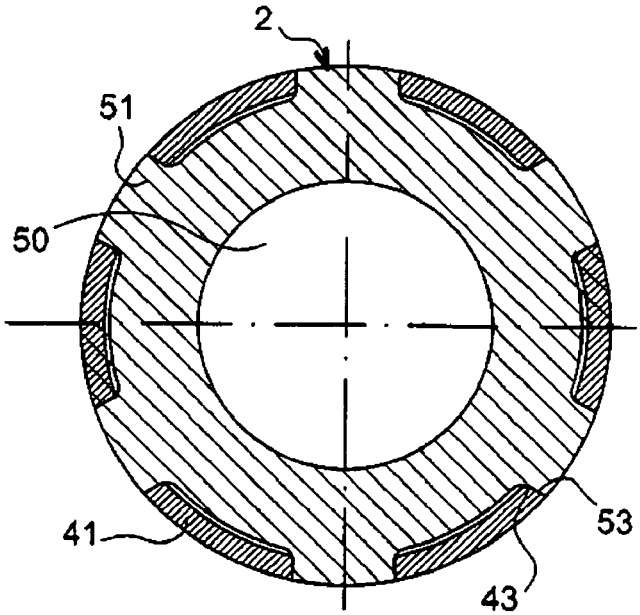

FIG. 3A contains an enlarged top view of the deformable tubular portion 4 of a stabilizer 1 according to the invention, when it is slid onto a rod 2 just in contact with shoulder 5 but not yet deformed. FIGS. 3B, 3C and 3D show cross sections through the deformable tubular portion 4, these sections being made at arbitrary marks A, B and C. The sections of the projecting parts 41 decrease as the distance from the end of the stabilizer decreases.

Figure 3E:
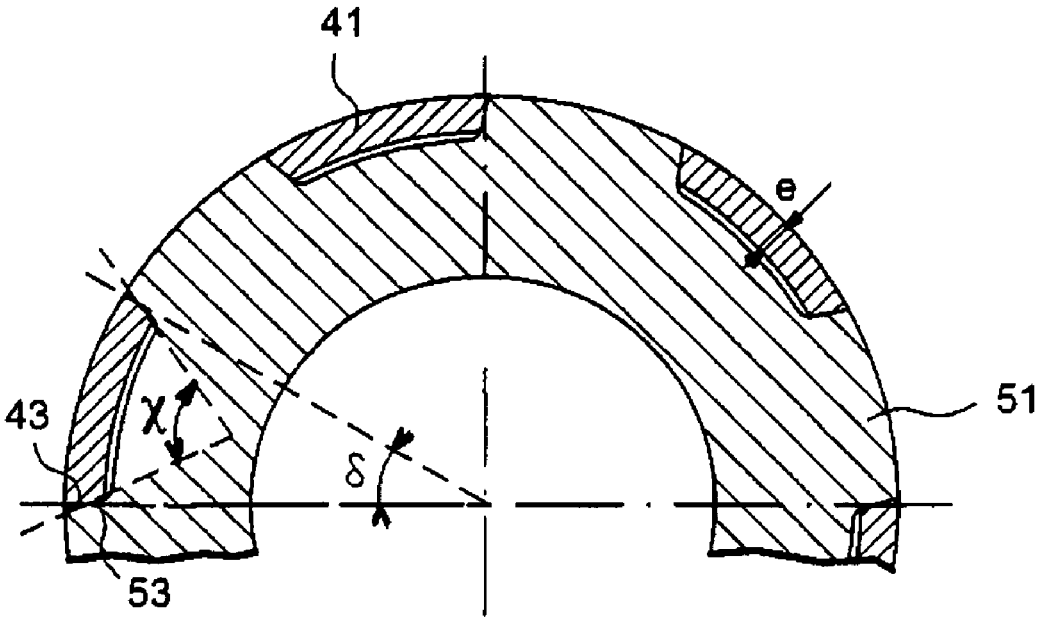
Figure 3F:
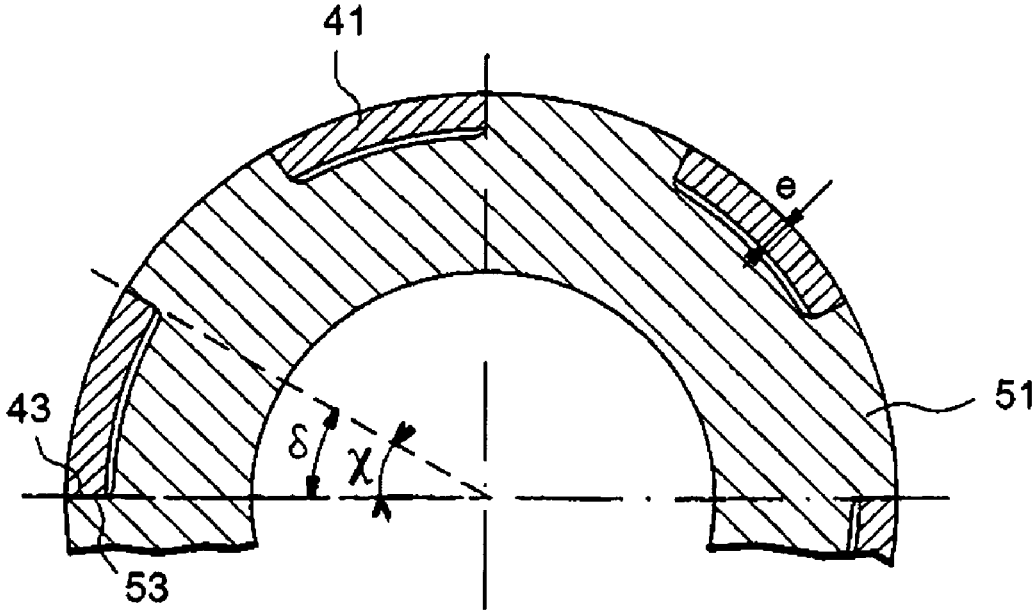

The two sides 43 of the same projecting part 41 of the deformable tubular portion 4 delimit an angle to the vertex equal to $\chi$, approximately constant for any one projecting part, which is greater than or equal to the angle at the vertex $\delta$ delimited by two radii R passing approximately at the mid-thickness of the two sides 43. In FIG. 3E, the angle $\chi$ is greater than the angle $\delta$. When the angle $\delta$ is equal to the angle $\chi$ as in FIG. 3F, the sides 43 are formed from a sequence of elements with a surface in the radial direction. The same comments are applicable to projecting parts of the shoulder since they have a geometry that matches the geometry of the deformable tubular portion 4. As the angle $\chi$ increases, then the projecting parts also deform quickly when the stabilizer comes into contact in compression with the shoulder, all other things being equal.

The angle δ determines the number of projecting parts 41 along the deformable tubular portion 4. Preferably, steps are taken such that the projecting part 41 and the recessed parts 42 separating them are equal.

The elastic part 4 has two functions in the embodiment shown in FIG. 3, it prevents the appearance of a longitudinal play between the stabilizer 1 and the rod 2, and fixes the stabilizer 1 in rotation with respect to rod 2. It prevents relative displacement in translation and in rotation between the stabilizer 1 and the rod 2.

In this embodiment, with an assembly of one rod and at least one stabilizer similar to that shown in FIGS. 3A to 3D, the deformable tubular portion 4 of the stabilizer 1 comprises six projecting parts. The length L of the projecting parts 41 is of the order of 50 millimeters (FIG. 3A). The inside diameter D1 of the stabilizer 1 is of the order of 175 millimeters (FIG. 3C), and the outside diameter D2 of the stabilizer 1 (FIG. 3C) at the deformable tubular portion is of the order of 200 millimeters. The thickness e (FIG. 3C) of projecting parts is of the order of 12 millimeters. The thickness of projecting parts of the shoulder is greater than or equal to the thickness of the projecting parts of the deformable tubular portion.

The angle χ was chosen to be equal to the angle δ, which is equal to about 30°. The angle at the vertex β of a projecting part is of the order of 40° (FIG. 3A). The angle α is of the order of 20° (FIG. 3A). This angle α determines the pitch of the spiral that generates the surface of the sides of the projecting parts of the tubular portion. The pitch p equal to approximately 1700 millimeters is given by:

$$P=\pi\times D2\times\tan(\alpha)$$

The stabilizer and the rod were both made from stainless steel, for which the Young's modulus Y varies between about $200\times10^{9}$ Pa, and the coefficient of thermal expansion is $16\times10^{-6}$/° C.

This type of stabilizer 1 may be made from a material other than stainless steel. The same is true for the rod 2. There is no need for the stabilizer and the rod to be made of the same material. They may have different coefficients of thermal expansion since the elastic part compensates for any play that is introduced during use. However, it is preferable if the mechanical properties of the materials used for the rod and the sleeve are approximately the same.

When the stabilizer came into contact with the shoulder with F=0, the first space J was equal to 1.3 millimeters. After a force F of about 70 tonnes has been applied, the stabilizer has moved through a distance of about 0.9 millimeters. The second space J1 was equal to about 0.4 millimeters in the initial position.

The geometric constraints that enable the stabilizer to remain in compression against the shoulder while remaining blocked in rotation regardless of the mechanical changes that occur between the stabilizer and the rod are expressed as follows:

$$\beta=2\alpha \text{ where } \alpha>0$$

It is considered that the angle α is positive if the projecting parts are narrower at their end than at their base.

$$\chi\geqq\delta$$

$$J1>0$$

It is considered that the second space J1 is positive if its sign is the same as the first space J.

The other parameters may vary so as to satisfy specific constraints, and particularly e, L, χ, β are used to adjust the torque to be applied. J, χ, β, Y will be adjusted to obtain a determined travel distance J–J1 with a given force F. α, χ, e, Y, and the roughness of the sides in contact, and the coefficient of relative friction between the materials from which the shoulder and the deformable tubular portion are made, will be adjusted to obtain a determined force F.

Figure 5:
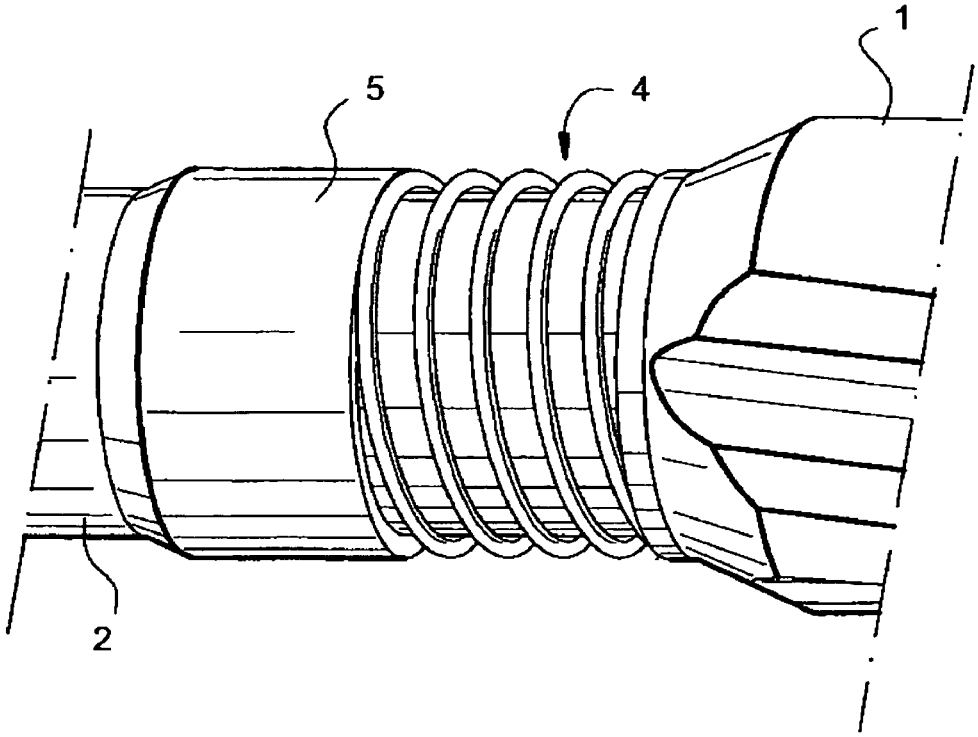
FIG. 5 shows a variant of the elastic part of the stabilizer.

It would be possible for the end of the stabilizer 1 that is in compression with the shoulder 5 to be machined in spiral form so as to form the elastic part 4, which would be a coil spring. The shoulder 5 of the rod 2 would then have radial sides that act as a bearing for the elastic part 4. The deformation of the elastic part 4 during placement of the stabilizer 1 would correspond to compression of the spring. This variant is shown diagrammatically in FIG. 5. The disadvantage of this embodiment is that it is impossible to guarantee precise angular positioning (registration is optical) of the stabilizer 1, either during assembly or during use.

Figure 6:
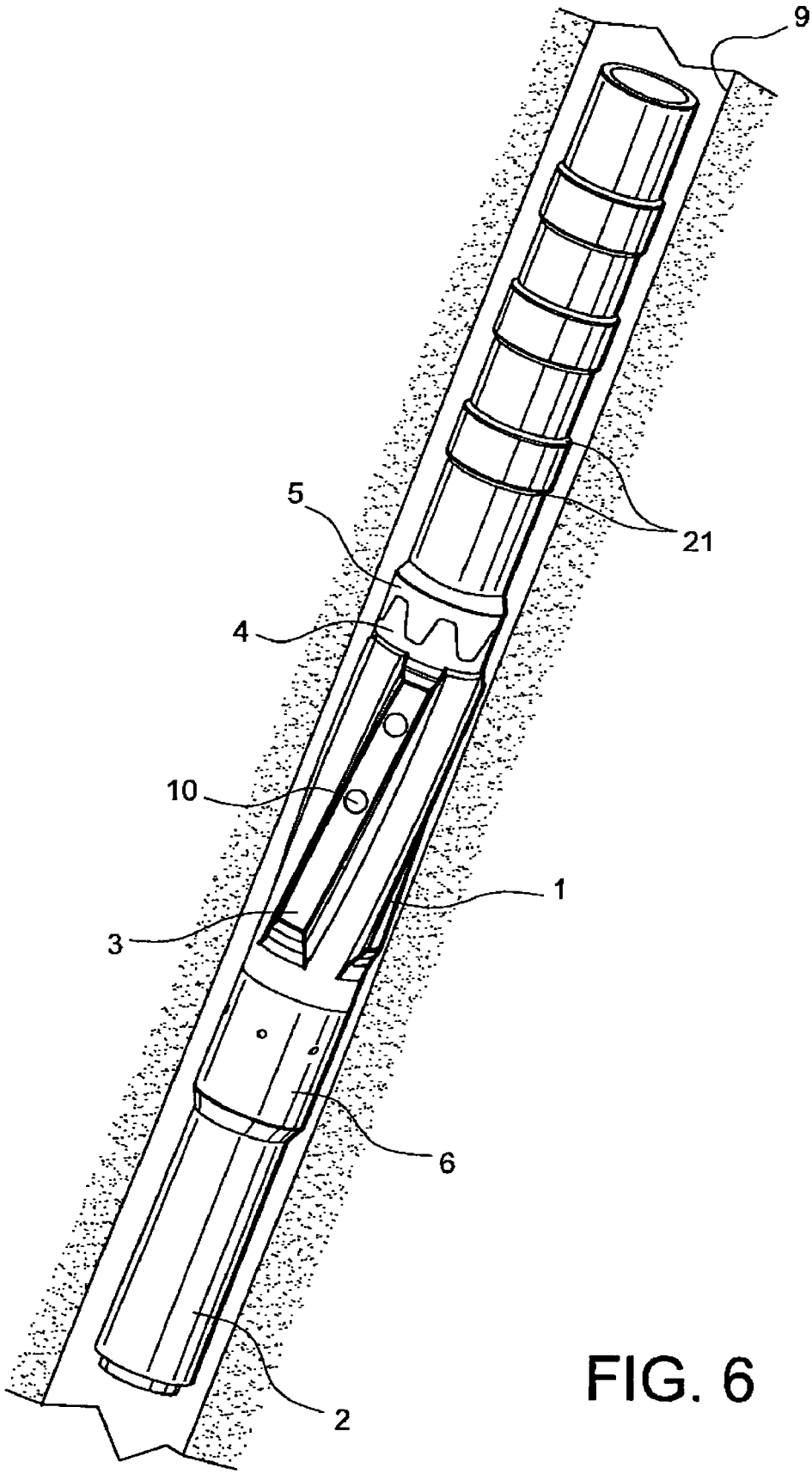
FIG. 6 shows a rod-stabilizer assembly according to the invention, the rod is of the logging while drilling type tool and/or measurement while drilling type tool.

FIG. 6 shows an assembly formed of a rod 2 and a stabilizer 1 according to the invention, in position in a borehole 9. A drilling tool (not shown) would be fixed to the bottom part of the assembly. Another rod (not shown) will be fixed to the top part of the assembly. Working upwards towards the surface, there are compression means 6, the stabilizer slid onto the rod 2 with its elastic part 4 at the end opposite to the end that cooperates with the compression means 6, and the shoulder of rod 5. Above the stabilizer 1, the rod 2 houses at least one measurement device 21 materialized by a sequence of rings, these rings representing for example a sequence of electrodes or sensors. When instrumented, this type of rod 2 may be of the LWD and/or MWD type.

A stabilizer like that described above is sufficiently robust to resist the difficult conditions encountered during drilling, without damage. In the embodiment in FIG. 1, it is positioned precisely with respect to the rod both longitudinally and in orientation, and it maintains its position during drilling.

It is easy to make and its cost is not prohibitive. Parts projecting from the deformable tubular portion may easily be made by machining on a lathe and a cutter. The same is true for projecting parts of the shoulder of the rod. It is also fast and easy to put the stabilizer into place and to replace it if wear occurs or if the dimensions of the borehole should change.

Although several embodiments of this invention have been represented and described in detail, it will be understood that different changes and modifications may be made without going outside the framework of the invention, particularly for the elastic part.

The invention claimed is:

1. Stabilizer (1) designed to be slid onto a rod (2), wherein it comprises at least one elastic part (4) that can deform when the stabilizer (1) is held in an initial position in compression against a shoulder (5) of the rod (2), this elastic part (4) compensating for play that may appear later between the stabilizer (1) and the rod (2) wherein the elastic part being a deformable tubular portion and comprises a series of projecting parts around its periphery, and oriented longitudinally and separated by recessed parts.

2. Stabilizer according to claim 1, wherein the play is longitudinal.

3. Stabilizer according to either claim 1, wherein the elastic part (4) co-operates with the shoulder (5) to block the stabilizer (1) in rotation with respect to the rod (2) in the initial position, this blockage in rotation being kept later.

4. Stabilizer according to claim 1, wherein the elastic part (4) is located at one end of the stabilizer and it will come into contact with the shoulder (5) of the rod (2).

5. Stabilizer according to claim 1, wherein it also comprises a part more rigid than the elastic part (4), this part also being practically non deformable.

6. Stabilizer according to claim 1 wherein it is in the shape of a sleeve, the deformable tubular portion of the sleeve being reversibly deformable.

7. Stabilizer according to claim 1, wherein the projecting parts (41) will cooperate with the projecting parts (51) of the shoulder (5), the projecting parts (41) of the deformable tubular portion (4) being provided with sides (43) that maintain sliding and separating contact with the sides (53) of the projecting parts (51) of the shoulder (5) during initial positioning.

8. Stabilizer according to claim 1 wherein the sides (43) of the projecting parts (41) of the deformable tubular section (41) essentially have a spiral-shaped profile.

9. Stabilizer according to claim 1, wherein a cross-section shows two sides (43) of a part (41) projecting from the deformable tubular portion (4) delimiting an angle at the vertex ($\chi$) that is greater than or equal to the angle at the vertex ($\delta$) delimited by two radii (R) of the tubular portion passing approximately at the mid-thickness (e) of the two sides (43).

10. Stabilizer according to claim 1, wherein the projecting parts (41) of the deformable tubular portion (4) are flared on their end and have longitudinal symmetry.

11. Rod (2) that will be fitted with at least one stabilizer (4) according to claim 1 wherein it comprises a shoulder (5) that will cooperate with the stabilizer.

12. Rod according to claim 11, wherein the geometry of the shoulder (5) matches the geometry of the elastic part (4).

13. Rod according claim 11, designed to hold external means (61) that help to keep the stabilizer (1) in compression, wherein it comprises means (60) contributing to holding the stabilizer (1) in compression against the shoulder (5), these means (60) being designed to cooperate with the external means (61).

14. Rod according to claim 13, wherein the means contributing to holding the stabilizer (1) in compression against the shoulder (5) comprise at least one zone (60) with a male thread.

15. Rod according to claim 13, wherein the means contributing to keeping the stabilizer (1) in compression in contact with the shoulder (5) comprise at least one housing (63) in which a part (64) will be fitted, one end of which is provided with a male thread.

16. Rod according to claim 11 wherein the shoulder (5) is sufficiently rigid to be practically non deformable.

17. Rod according to claim 11 wherein it is a rod in a string of drilling rods.

18. Rod according to claim 17, wherein it is a drill stem.

19. Rod according to claim 11 wherein it is a logging while drilling tool.

20. Rod according to claim 11 wherein it is a measurement while drilling tool.

21. Assembly formed from at least one rod (2) according to claim 11, the rod (2) carrying at least one stabilizer (1) according to one of claims 1 to 10, wherein it also comprises external means (61) contributing to holding the stabilizer (1) in compression with the shoulder (5) of rod (2).

22. Assembly according to claim 21, wherein the external means (61) are in the shape of a ring threaded on the inside to be screwed on the rod (2).

23. Assembly according to claim 21 wherein a first space (J) is formed between the end of the projecting parts (41) of the deformable tubular part (4) and the shoulder (5) when the stabilizer is in position in contact with the shoulder (5) without compression, a second space (J1) is formed between the end of the projecting part (41) of the deformable tubular part (4) and the shoulder (5) when the stabilizer (1) is in the initial position, the second space (J1) being less than the first space (J).

24. Rod (2) that will be fitted with at least one stabilizer (4) according to claim 1, wherein it comprises a shoulder (5) that will cooperate with the stabilizer.

25. Rod (2) that will be fitted with at least one stabilizer (4) according to claim 11, wherein it comprises a shoulder (5) that will cooperate with the stabilizer.

26. Rod according to claim 13, wherein the shoulder (5) is sufficiently rigid to be practically non deformable.

27. Rod according to claim 13, wherein it is a rod in a string of drilling rods.

28. Rod according to claim 13, wherein it is a logging while drilling tool.

29. Rod according to 11, wherein it is a measurement while drilling tool.

30. Rod according to 13, wherein it is a measurement while drilling tool.

31. Assembly formed from at least one rod (2) according to claim 13, the rod (2) carrying at least one stabilizer (1) according to one of claims 1 to 10, wherein it also comprises external means (61) contributing to holding the stabilizer (1) in compression with the shoulder (5) of rod (2).

32. Assembly according to claim 31, wherein the external means (61) are in the shape of a ring threaded on the inside to be screwed on the rod (2).

33. Assembly according to claim 31, wherein a first space (J) is formed between the end of the projecting parts (41) of the deformable tubular part (4) and the shoulder (5) when the stabilizer is in position in contact with the shoulder (5) without compression, a second space (J1) is formed between the end of the projecting part (41) of the deformable tubular part (4) and the shoulder (5) when the stabilizer (1) is in the initial position, the second space (J1) being less than the first space (J).

* * * * *